United States Patent [19]

Johnston et al.

[11] Patent Number: 4,483,044

[45] Date of Patent: Nov. 20, 1984

[54] PNEUMATIC DOOR CLOSER HAVING RESILIENT BRAKING SLEEVE AND COOPERATING PISTON ROD INCREMENTAL BRAKING ENLARGEMENTS

[75] Inventors: James R. Johnston, Sterling; Cordell E. Meiste, Morrison, both of Ill.

[73] Assignee: National Manufacturing Co., Sterling, Ill.

[21] Appl. No.: 521,155

[22] Filed: Aug. 8, 1983

Related U.S. Application Data

[63] Continuation-in-part of Ser. No. 424,059, Sep. 27, 1982, abandoned.

[51] Int. Cl.[3] ..... E05F 3/16

[52] U.S. Cl. ..... 16/70; 16/80; 16/86 R; 16/341; 16/DIG. 17; 92/10; 92/85 R; 92/85 B

[58] Field of Search ..... 16/58, 70, 74, 75, 76, 16/80, 86 RA–86 C, 337, 341, DIG. 7, DIG. 10, DIG. 17; 188/67, 129, 271, 284, 322.17; 92/10, 11, 85 R, 85 B, 143; 267/33

[56] References Cited

U.S. PATENT DOCUMENTS

| | | | |
|---|---|---|---|
| 1,818,250 | 8/1931 | Harrah et al. | 16/84 |
| 2,212,789 | 8/1940 | Newell | 16/70 |
| 2,224,147 | 12/1940 | Ehlers | 188/67 X |
| 2,569,616 | 10/1951 | Mann | 188/67 X |
| 2,650,386 | 9/1953 | Edwards | 16/65 X |
| 2,666,944 | 1/1954 | Stehlin | 16/70 |
| 2,897,534 | 8/1959 | Pickerell | 16/70 |
| 2,940,552 | 6/1960 | Freyler | 188/129 |

FOREIGN PATENT DOCUMENTS

| | | | |
|---|---|---|---|
| 2449661 | 4/1976 | Fed. Rep. of Germany | 16/DIG. 7 |
| 1414880 | 9/1965 | France | 16/337 |
| 2482650 | 11/1981 | France | 16/337 |

*Primary Examiner*—Fred A. Silverberg
*Attorney, Agent, or Firm*—Edmond T. Patnaude

[57] ABSTRACT

Door speed is controlled by a pneumatic dashpot including a spring-loaded piston having a piston rod which extends through an elastomeric silicone rubber braking sleeve which is longitudinally compressed as the door opens to increase the friction between the piston rod and the sleeve. One or more enlargements on the piston rod provide increased friction as the rod moves through the braking sleeve to control closing speed and to provide greater wind resistance.

7 Claims, 10 Drawing Figures

FIG. 2
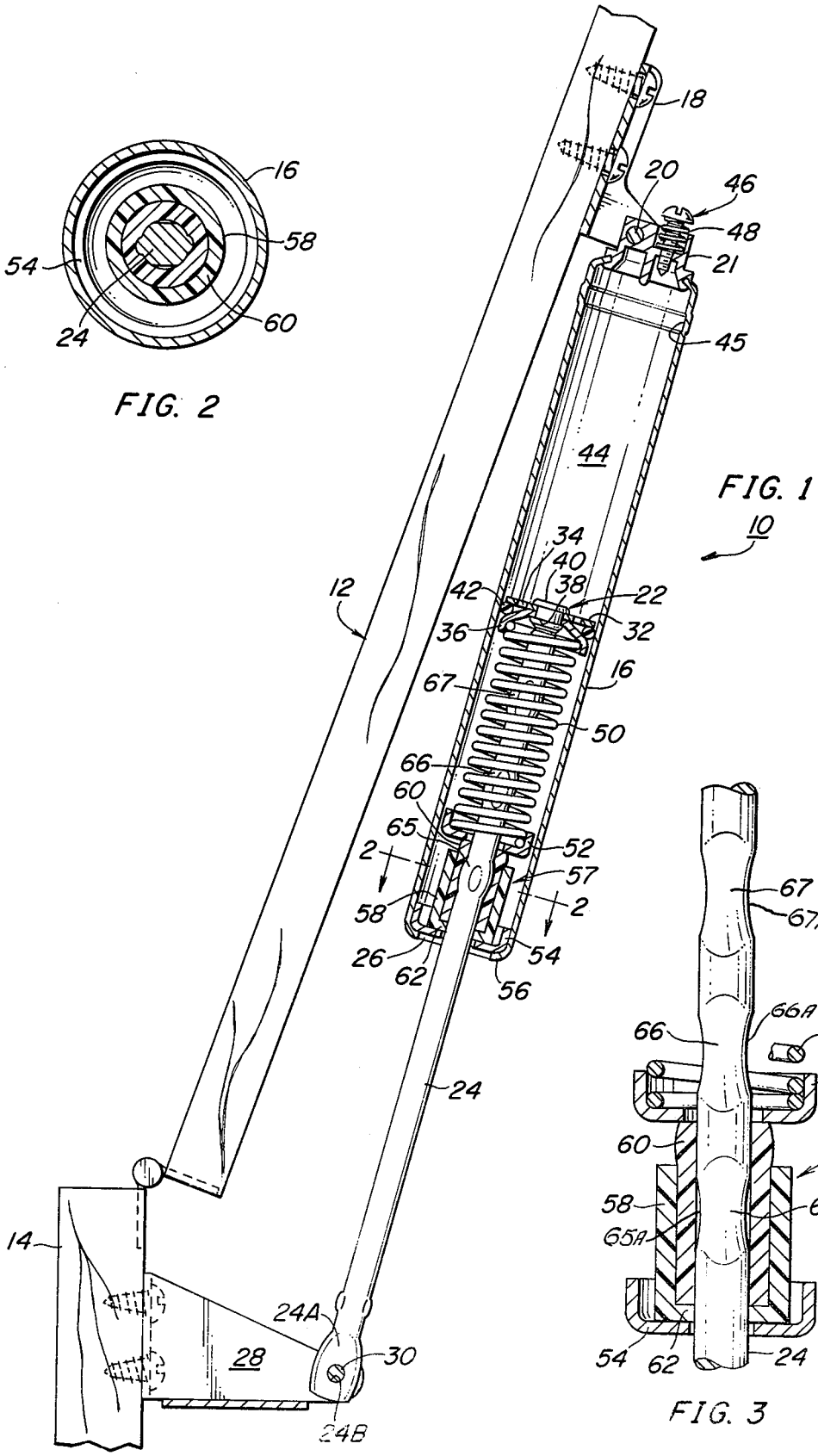
FIG. 1
10
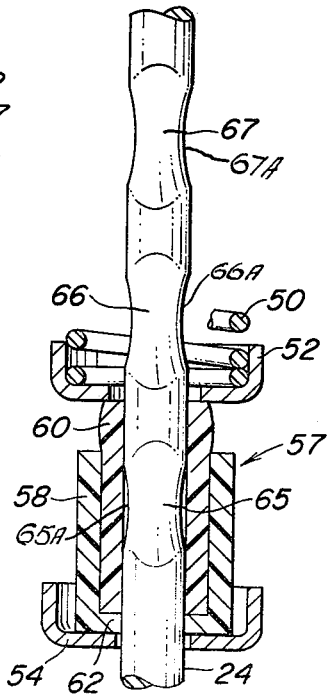
FIG. 3

PNEUMATIC DOOR CLOSER HAVING RESILIENT BRAKING SLEEVE AND COOPERATING PISTON ROD INCREMENTAL BRAKING ENLARGEMENTS

SPECIFICATION

This application is a continuation-in-part of abandoned application Ser. No. 424,059, filed by us on Sept. 27, 1982, now abandoned.

The present invention relates in general to pneumatic door closers of the type incorporating a return spring in combination with a pneumatic dashpot and a longitudinally compressible braking sleeve through which the piston rod extends for resisting movement of the associated door, and it relates in particular to a new and improved piston rod construction which increases the braking force exerted by the sleeve when the door is in a substantially open position.

BACKGROUND OF THE INVENTION

In our copending application Ser. No. 06/348,608 filed Feb. 12, 1982, and assigned to the assignee of the present invention, there is described a pneumatic door closer wherein a piston rod extends through an elastomeric sleeve which is progressively compressed in an axial direction as the associated door is opened thereby to exert an increasing frictional braking force on the piston rod. The door closer of the present invention is an improvement over the earlier disclosed door closer in that it increases the braking action while the door is substantially open, say about sixty degrees or more, for better wind resistance and for preventing inadvertent slamming of the door into the fully open position. Moreover, the improved door closer of the present invention exerts a force which increasingly opposes swinging movement of the door as the door swings from the fully closed position toward the fully open position. The decreasing braking force results in a smooth, nonbounce return of the door from an open to a closed position.

SUMMARY OF THE INVENTION

Briefly, there is provided in accordance with the present invention a pneumatic door closer which includes a novel braking means which increasingly resists door movement as the door swings from a fully closed to a fully open position.

In one embodiment of the invention the braking effect is increased in discrete, successive increments, while in another embodiment of the invention the braking effect increases smoothly as the door swings toward a fully open position.

In the preferred embodiments of the invention shown in the drawings and described in detail hereinafter a plurality of braking sleeves are formed of silicone rubber to maintain their resiliency at temperatures well below zero degrees Farenheit, and the piston rod is provided with one or more enlargements which move into the braking sleeves as the associated door is opened to about sixty degrees and beyond. As the enlargements move into the braking sleeves there is an increased resistance to further opening of the door. The incremental increases in resistance provided in one embodiment must be overcome in order to open the door and these increases further provide a warning against and a deterent to excessive opening of the door. Moreover, during the spring controlled return of the door, the closing speed is made more uniform inasmuch as the increased braking effect of one or more enlargements takes effect where the mechanical advantage of the spring mechanism is greatest, i.e., the door is in a substantially open position.

In the preferred embodiments of the invention the braking means includes a rigid retainer tube from the ends of which an elastomeric brake sleeve means extends. The brake sleeve means includes a plurality of axially aligned silicone rubber sleeves through which the piston rod extends. It is the two ends of each brake sleeve which grip the rod as the sleeves are axially compressed. Consequently, the braking effect is substantially doubled by doubling the number of brake sleeves.

GENERAL DESCRIPTION OF THE DRAWINGS

The present invention will be better understood by a reading of the following detailed description taken in connection with the accompanying drawings wherein:

FIG. 1 is a horizontal cross-sectional view of a door closer embodying the present invention, the door closer being mounted between a door and a door jamb;

FIG. 2 is a cross-sectional view taken along the line 2—2 in FIG. 1;

FIG. 3 is an enlarged, cross-sectional view of the friction brake of the present invention.

DETAILED DESCRIPTION OF A PREFERRED EMBODIMENT OF THE INVENTION

Figures 4, 5, 6, 7, 8, 9, 10:
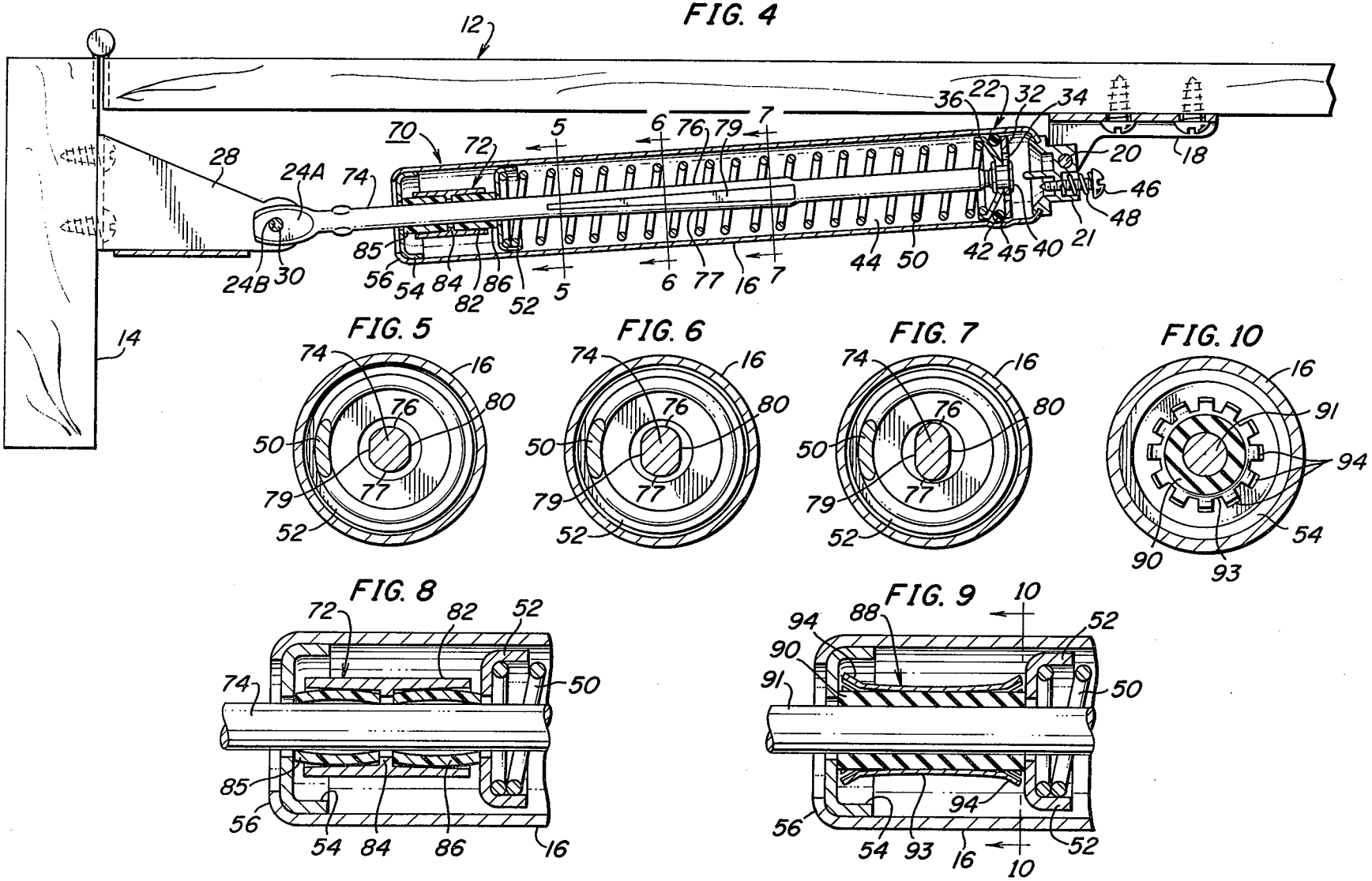
FIG. 4 is a horizontal cross-sectional view of a door closer embodying another aspect of the present invention, the door closer being mounted between a door and the jamb of a door frame.
FIG. 5 is a cross-sectional view taken along the line 5—5 in FIG. 4.
FIG. 6 is a cross-sectional view taken along the line 6—6 in FIG. 4.
FIG. 7 is a cross-sectional view taken along the line 7—7 in FIG. 4.
FIG. 8 is an enlarged cross-sectional view showing the braking means of FIG. 4 in the compressed, braking condition.
FIG. 9 is an enlarged cross-sectional view of an alternative braking means.
FIG. 10 is a cross-sectional view taken along the line 10—10 in FIG. 9.

Referring to FIG. 1, a door closer 10 is mounted between a door 12 and a door jamb 14. The door 12 is shown in an open position of about seventy degrees, that being the usual extent to which a door is opened by a person passing through the associated doorway.

The door closer 10 includes a cylindrical housing 16 which is pivotably attached to the door 12 by means of a bracket 18 and a pivot pin 20 which loosely extends through aligned holes in the bracket 18 and an end cover 21 fixedly and sealably attached to the tubular housing 16. Slidably mounted within the housing 16 is a piston and check valve assembly 22 to which a piston rod 24 is fixedly connected. The rod 24 extends through the end 16 of the housing and is pivotably connected to the jamb 14 by means of a bracket 28 and a pivot pin 30.

Considered in greater detail, the distal end of the piston rod 24 is flattened at 24A and provided with a cylindrical hole 24B through which the pivot pin 30 loosely extends. As shown, the pin 30 extends through a mutually aligned opening in the bracket 28.

It will be understood that any other suitable means for pivotably connecting the piston rod 24 and the housing 16 to the door and to the jamb may be used if desired.

The piston and check valve assembly 22 includes a piston washer 32 having one or more orifices 34 provided therein. An imperforate, generally conical piston member 36 is fixedly clamped against the piston washer 32 by means of the piston rod 24. More particularly, the piston member 36 is positioned against a flange 38 on the rod 24 and the end portion 40 thereof is pressed over the outer face of the washer 32. A resilient O-ring 42 is disposed between the piston member 36 and the piston washer 32 and sealably engages the interior wall of the housing member 16 except when the door 12 is nearly fully closed and the O-ring 42 is located over a short axial groove 45 near the outer end of the housing member 16.

As is explained more fully hereinafter, as the door 12 is opened and the piston rod 24 is pulled out of the housing 16, downwardly as shown in FIG. 1, the O-ring 42 moves away from the piston member 36 and air flows through the orifices 34 into a dashpot chamber 44 located between the piston and check valve assembly 22 and the end cover 21. When the door 12 is subsequently closed, the O-ring 42 is compressed against the piston member 36 and thereby seals the lower end of the chamber 44 from the atmosphere. A conventional screw-type bleed valve 46 is threadedly mounted in a bleed orifice through the end cover 21 to control the rate at which air may exit the chamber 44 and permit the door to close. The bleed valve is adjustable and includes a coil spring 48 to prevent spurious rotation of the bleed valve 46.

The door closer 10 further includes a door return spring 50 in the form of a coil spring through which the piston rod 24 extends. The spring 50 is compressed between the piston member 36 and an annular cup member 52 which is freely slidable on the piston rod 24. The external diameter of the cup 52 is substantially less than the internal diameter of the housing member 16. A second cup member 54 is fitted into the end 26 of the housing member 16, and the member 16 is deformed thereover to provide an internal flange 56 which prevents the cup member 54 from moving out of the end 26 of the housing.

Between the cups 52 and 54 there is mounted over the piston rod 24 a braking and energy absorbing device 57 comprising a rigid, tubular retainer 58 and an elastomeric sleeve 60. An internal flange 62 at the lower end of the retainer 58 is apertured to permit the piston rod 24 to slide freely therethrough. The retainer 58 has a main tubular portion having an internal diameter which is slightly greater than the external diameter of the sleeve 60, and the internal diameter of the sleeve 60 is slightly greater than the external diameter of the rod 24 when the sleeve 60 is in a relieved condition. The sleeve is longer than the retainer and thus extends a substantial distance from the retainer into engagement with the cup member 52.

As thus far described, the door closer 10 is essentially the same as the door closer described in the above referenced copending patent application and operates in the manner described in that application. Accordingly, as the door is swung open and the rod is pulled out of the housing, the braking sleeve 60 is longitudinally compressed and applies an increasing friction braking force on the piston rod which resists both opening and closing movement of the door.

In accordance with one aspect of the present invention the piston rod 24 is provided with a plurality of spaced apart enlargements 65, 66 and 67 which respectively increase the braking action of the sleeve 60 as they move through the sleeve. As the door 12 is moved toward its fully open position, not only does the braking force gradually increase as the braking sleeve is increasingly compressed, but incremental increases in the braking force are also applied to the rod as the enlargements move through the braking sleeve.

In this embodiment of the invention, the first enlargement to enter the braking sleeve as the door is moved from the closed position toward the fully open position is the enlargement 65 and it is located along the rod 24 so as to enter the braking sleeve when the door is between about sixty percent and seventy percent of the fully open position. This is the position normally occupied by a door as a person simply walks through the associated doorway. At that point there is a noticeable increase in the resistance to further opening of the door.

The second enlargement 66 is spaced from the first enlargement by a distance no greater than the length of the braking sleeve so as to enter the sleeve before the first enlargement 64 moves out of the sleeve as the door is moved toward the fully open position. The last enlargement 67 is located so as to be within the sleeve 60 when the door is fully open and to provide a maximum resistance to door movement. Preferably, the enlargement 67 is larger than the enlargement 66 which is in turn larger than the enlargement 65. In this way, the increase in mechanical advantage which occurs as the door moves toward the fully open position is compensated for by the increase in the incremental increased braking force applied to the piston rod 24 as the progressively larger bulges move into the braking sleeve.

In accordance with another feature of the present invention, the braking sleeve is formed of silicone rubber which we have found retains its resiliency and surface friction at low temperatures better than natural or synthetic rubber. For example, a door closer incorporating a silicone rubber braking sleeve and having a four second closing time at 70° F., will have a closing time between four and five seconds at −10° F. However, with a door closer incorporating natural or synthetic rubber braking sleeves, the closing time increased from four seconds at 70° F., to about thirty seconds at −10° F.

In the embodiment shown in FIG. 1, the enlargement 65 will be within the braking sleeve when the door is between sixty percent and seventy percent open; the enlargement 66 will be within the braking sleeve when the door is between seventy degrees and eighty-five degrees open; and the enlargement 67 will be within the braking sleeve when the door is between about eighty-five degrees and one hundred-five degrees from the fully closed position. The latter enlargement provides the maximum braking increment to provide the greatest resistance to the effect of the wind blowing against the door.

OPERATION

Preferably the door closer 10 is mounted between the door jamb and the door so that when the door is closed the spring 50 is slightly compressed to provide a preload of nineteen pounds between the piston rod 24 and the housing 16. Under these conditions the spring 50 is slightly compressed and the elastomeric sleeve 60 is only very slightly compressed longitudinally so that the internal surface thereof does not frictionally engage the external surface of the rod 24. As the door swings from the closed position and the piston rod 24 is retracted from the housing 16, the spring 50 is further compressed and the elastomeric sleeve 60 is also compressed in its axial direction. The sleeve 60 is thus increasingly compressed as the door swings open whereby it more tightly grips the rod 24 to provide an increased braking action against movement of the rod through the sleeve 60 and out of the housing 16. It may be seen that the high gripping force is exerted by the elastomeric sleeve 60 on the rod 24 because of the fact that the sleeve is confined by the retainer 54 and can, therefore, only expand inwardly against the rod.

When the door is opened to about the 60° position, the first enlargement 65 begins to enter the braking sleeve whereby the sleeve exerts a greater force on the piston rod to resist movement of the door. When the door is simply thrown open, the increasing resistive force will usually stop the door before it reaches the fully open position where damage might be done to the door or to the associated hinges. The enlargements 65, 66, and 67 also retard opening of the door by the wind.

Inasmuch as the enlargements are effective only when the door has been substantially opened and the mechanical force is substantial, a smoother closing of the door can be achieved. It will be understood that the sizes and locations of the enlargements should be matched to the characteristics of the door closer design and to the desired operating characteristics thereof. By utilizing the enlargements in conjunction with a longitudinally compressed braking sleeve the load-deflection characteristics of the door closer can be closely controlled throughout the full range of door movement.

The enlargements 65, 66 and 67 may be effected by embossing the rod at the desired locations. In a preferred embodiment of the invention the piston rod 24 has an external diameter of 0.312 inch; the enlargement 64 has a nominal cross-sectional dimension of 0.325 inch; the enlargement 66 has a nominal cross-sectional dimension of 0.335 inch; and the enlargements are located on one inch centers. The braking sleeve has an unstressed internal diameter of 0.320 inch. However, due to axial compression the internal diameter of the braking sleeve is reduced to about 0.312 inch when the door has been opened to about five to ten degrees.

As may be seen in FIG. 3, when the enlargements 65, 66 and 67 are effected by embossing or compressing spaced locations on the rod, shallow recesses 65A, 66A and 67A are provided on opposite sides of the rod 24 at the longitudinal locations of the enlargements. Nevertheless, a substantial increase in the frictional braking force occurs as each enlargement and its corresponding recess move into the braking sleeve.

Referring now to FIG. 4, there is shown a door closer 70 which is similar to the door closer 10, but which includes a different braking and energy absorbing device 72 and a different piston rod 74. In other respects the door closer 70 is identical to the door closer 10 and like parts are identified by like reference characters. Moreover, the door closer 70 is shown connected between the door 12 and the door jamb 14, the door 12 being shown in fully closed position.

The piston rod 74 has its distal end pivotally connected to the bracket 28 and its other end fixedly connected to the piston assembly 22. The rod 74 includes a pair of tapered enlargements 76 and 77 on diametrically opposite sides and diametrically opposite, tapered flats 79 and 80 extending throughout the intermediate portion of the rod. The remainder of the piston rod 74 is circular in cross-section. The enlargements 76 and 77 may be produced in an embossing operation.

The braking and energy absorbing means 72 includes a rigid, non-deformable tubular retainer 82 suitably molded of a rigid plastic. An annular, internal flange 84, which is preferably an integral part of the retainer 82, has a central circular opening which is sufficiently large in cross-section to permit the entire enlargement 79 to slide freely therethrough. A pair of elastomeric sleeves 85 and 86 are fitted into the respective ends of the retainer 82 and abut the adjacent sides of the flange 85. As may be seen, the elastomeric sleeves extend outwardly from opposite ends of the retainer with the sleeve 85 compressed between the flange 85 and the cup 52. The internal diameters of the sleeves 85 and 86 are the same and slightly greater than the diameter of the cylindrical portion of the piston rod 74 to permit the rod 74 to slide freely therethrough when the sleeves are in a substantially non-compressed condition as shown in FIG. 4.

As the door 12 swings open, the piston assembly 22 is pulled toward the braking means 72 and an axial compressive force is applied to the two sleeves 85, 86. The intermediate portions of the sleeves 85, 86 buckle outwardly a small amount as shown in FIG. 8 so that the inner edges at both ends of the sleeves 85, 86 bite against the piston rod 74 to exert a braking force thereon. We have found the most of the braking action takes place at the ends of the brake sleeves and that two brake sleeves exert a substantially greater braking force than does the single sleeve. Moreover, since the portion of the longitudinally tapered enlargements 76, 77 positioned within the braking means 72 gradually increases in size as the door swings toward the fully open position, the additional braking force provided by the enlargements 76, 77 also gradually increases.

It will be understood by those skilled in the art that the piston rod 24 described in connection with FIGS. 1-2, may be used in place of the piston rod 74 in the door closer 70, and in that case the braking force will increase in discrete increments as the individual pairs of enlargements move into the braking means 72.

Referring to FIGS. 9 and 10 there is shown a braking and energy absorbing means 88 for use in either the door closer 10 or the door closer 70. As there shown, the braking means 88 comprises an elastomeric sleeve 90 through which a piston rod 91 extends. The sleeve 90 extends through a retainer tube 93 having outwardly flared end portions which are longitudinally slit to provide a plurality of spring fibers 94. As the associated door is opened, the sleeve 90 is axially compressed between the cups 52 and 54 to exert a braking force on the rod 91. Moreover, the ends of the retainer 93 engage the cups 52 and 54 and maintain the sleeve 90 centered on the rod 91.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. In a door closer attached to an associated door and having a rod which moves within resilient sleeve means for resisting said rod movement as said door is moved between fully open and closed positions, the improvement comprising at least one enlargement on said rod, said enlargement being sized and longitudinally located on said rod so as to pass through said sleeve means and to increase the resistance of said sleeve means to movement of said rod therein while said door moves through a partially open position, and means for longitudinally compressing said sleeve means as said door is moved from the closed position toward the fully open position, said enlargement being elongated in the axial direction of said rod and continuously increasing in size along the entire length of said enlargement along the length of said rod for always continuously increasing the resistance of said sleeve means to said rod movement during the entire movement of said door from an intermediate position to the fully open position.

2. The invention set forth in claim 1 wherein said sleeve is formed of silicone rubber.

3. The invention set forth in claim 1 wherein said enlargement is an embossment.

4. A door closer according to claim 1 wherein said sleeve means comprises a plurality of separate, axially aligned elastomeric tubular members through which said piston rod extends.

5. In a door closer according to claim 1, said intermediate position being between about 60° and 70° of the fully open position of said door.

6. A door closer for connecting a door member to a frame member comprising in combination an elongated cylinder, a piston mounted in said cylinder for axial movement in said cylinder, a piston rod connected at one end to said piston and extending out through one end of said cylinder, means for connecting said piston rod to one of said door or frame members, means for connecting said cylinder to the other one of said door or frame members, spring means disposed within said cylinder and surrounding said rod, brake means having an opening therethrough through which said rod extends, and said spring means being compressed between said piston and said brake means for exerting an increasing axial compressive force on said brake means as said door member swings in an opening direction, said brake means including a tubular retainer and elastomeric sleeve means positioned within said retainer and through which said rod extends, said sleeve means extending outwardly from both ends of said retainer, said retainer including an annular flange disposed intermediate the ends thereof, said sleeve means comprising a plurality of elastomeric sleeves respectively abutting said flange, one end of each of said sleeves abutting said flange, and the other end of each of said sleeves being disposed outside of said retainer.

7. In a door closer attached to an associated door and having a rod which moves within resilient sleeve means for resisting said rod movement as said door is moved between fully open and closed positions, the improvement comprising at least one enlargement on said rod, said enlargement being sized and longitudinally located on said rod so as to pass through the said sleeve means and to increase the resistance of said sleeve means to movement of said rod therein while said door moves through a partially open position, means for longitudinally compressing said sleeve means as said door is moved from the closed position toward the fully open position, a plurality of additional enlargements on said rod, said enlargements being progressively larger in size toward the portion of said rod which is disposed in said sleeve means when said door is fully open providing for progressive increase in the resistance of said sleeve means to said rod movement while said door moves through said partially open position.

* * * * *